US011344144B2

(12) United States Patent
Curtis

(10) Patent No.: US 11,344,144 B2
(45) Date of Patent: May 31, 2022

(54) THEFT PROOF STORAGE CONTAINER

(71) Applicant: Benjamin Kristopher Curtis, Wichita, KS (US)

(72) Inventor: Benjamin Kristopher Curtis, Wichita, KS (US)

(73) Assignee: Benjamin Kristopher Curtis, Witchita, KS (US)

( * ) Notice: Subject to any disclaimer, the term of this patent is extended or adjusted under 35 U.S.C. 154(b) by 0 days.

(21) Appl. No.: 17/113,156

(22) Filed: Dec. 7, 2020

(65) Prior Publication Data

US 2021/0196070 A1 Jul. 1, 2021

Related U.S. Application Data

(60) Provisional application No. 62/954,098, filed on Dec. 27, 2019.

(51) Int. Cl.

| | |
|---|---|
| ***A47G 29/12*** | (2006.01) |
| ***A47G 29/124*** | (2006.01) |
| ***A47G 29/14*** | (2006.01) |
| ***A47G 29/20*** | (2006.01) |

(52) U.S. Cl.

CPC ..... *A47G 29/1216* (2013.01); *A47G 29/124* (2013.01); *A47G 29/141* (2013.01); *A47G 29/20* (2013.01); *A47G 2029/144* (2013.01)

(58) Field of Classification Search

CPC .. A47G 29/1216; A47G 29/124; A47G 29/20; A47G 29/14; A47G 29/16; A47G 29/141; A47G 2029/144; A47G 2029/148

USPC ..... 232/17, 19, 22, 39, 45, 1 E

See application file for complete search history.

(56) References Cited

U.S. PATENT DOCUMENTS

| | | | | | |
|---|---|---|---|---|---|
| 1,847,969 | A * | 3/1932 | Letcher | A47G 29/20 | 232/42 |
| 4,703,850 | A * | 11/1987 | Walker | A45C 3/12 | 206/288 |
| 5,150,834 | A * | 9/1992 | Bourke | A47G 29/1203 | 232/1 C |
| 5,624,071 | A * | 4/1997 | Sosan | A47G 29/20 | 232/1 B |
| 6,155,715 | A * | 12/2000 | Lake | A47G 29/20 | 150/102 |
| 6,375,070 | B1 * | 4/2002 | Snoke | A47G 29/141 | 232/20 |
| 9,596,952 | B2 * | 3/2017 | Mencel | A47G 29/141 | |
| 10,321,780 | B1 * | 6/2019 | James | A47G 29/141 | |
| 10,383,471 | B1 * | 8/2019 | Barnes | A47G 29/20 | |
| 10,512,352 | B1 * | 12/2019 | Torres | A47G 29/22 | |
| 10,682,002 | B2 * | 6/2020 | Miller | A47G 29/20 | |
| 10,743,694 | B2 * | 8/2020 | Raphael | A47G 29/141 | |
| 10,786,103 | B2 * | 9/2020 | Teoh | B65D 11/1853 | |
| 10,869,570 | B2 * | 12/2020 | Dunkelberger | A44B 19/30 | |
| 10,932,602 | B2 * | 3/2021 | Hauck | A47G 29/12095 | |
| 10,993,567 | B1 * | 5/2021 | Cabral-McKeand | A47G 29/141 | |
| 11,026,531 | B2 * | 6/2021 | Campodonico | A47G 29/20 | |
| 11,109,705 | B2 * | 9/2021 | Raphael | A47G 29/20 | |

(Continued)

*Primary Examiner* — William L Miller

(74) *Attorney, Agent, or Firm* — Stinson LLP

(57) ABSTRACT

A storage container securable to the exterior of a home, office or other building for enclosing one or more packages is disclosed herein. The container may be coupled to a door or window of the building without destruction of the exterior surface of the door or window. The storage container may be sized and shaped for various sized packages.

16 Claims, 4 Drawing Sheets

(56) References Cited

U.S. PATENT DOCUMENTS

| | | | | |
|---|---|---|---|---|
| 2015/0297013 | A1* | 10/2015 | Bolles | A47G 29/1251 232/17 |
| 2016/0068306 | A1* | 3/2016 | Heinz | B65D 81/02 220/560.01 |
| 2017/0127868 | A1* | 5/2017 | Adewuyi | A47G 29/141 |
| 2017/0188737 | A1* | 7/2017 | Hippert | A47G 29/20 |
| 2018/0296016 | A1* | 10/2018 | Teoh | B65D 11/1853 |
| 2019/0223644 | A1* | 7/2019 | Hopp | A47G 29/20 |
| 2019/0246828 | A1* | 8/2019 | Miller | A47G 29/20 |
| 2019/0350398 | A1* | 11/2019 | Raphael | A47G 29/141 |
| 2020/0060460 | A1* | 2/2020 | Farrar | A47G 29/141 |
| 2020/0093309 | A1* | 3/2020 | Raphael | A47B 96/16 |
| 2020/0275795 | A1* | 9/2020 | Campodonico | A47G 29/12095 |
| 2020/0323377 | A1* | 10/2020 | O'Connor | A47G 29/20 |
| 2020/0383508 | A1* | 12/2020 | Arif | A47G 29/20 |
| 2021/0127880 | A1* | 5/2021 | Raphael | A47G 29/141 |

* cited by examiner

THEFT PROOF STORAGE CONTAINER

CROSS-REFERENCE TO RELATED APPLICATION(S)

The present application claims priority to U.S. Provisional Application Ser. No. 62/954,098, filed Dec. 27, 2019, which is hereby incorporated by reference in its entirety.

BACKGROUND OF THE DISCLOSURE

The present disclosure is generally directed to a storage container secured to the exterior of a home, office or other building for enclosing one or more packages. Particularly, the container can be secured to a door or window of the building without destruction of the exterior surface of the door or window. The storage container can be sized and shaped for various sized packages.

At home delivery of goods is becoming increasingly popular. With the rise of companies such as Amazon, it is important to ensure that the packages being delivered are without risk of being wrongly taken from the exterior of the home before being collected by the consumer. Currently, storage containers are available for use in enclosing packages. The containers are secured to a consumer's home or exterior of the home (e.g., door or window or patio) with the use of bolts or screws. This may prevent the packages from being wrongfully taken, but can cause irreversible damage to the home. Further, the containers are not easily removed once secured to the home.

It would be advantageous if a storage container could be provided that could provide security to the consumer's purchased goods while being easily secured to the home without damaging the exterior surface. Further, it would be beneficial if the storage container could be easily removed and subsequently reused in another location.

BRIEF DESCRIPTION OF THE DISCLOSURE

The present disclosure is directed to a storage container for use by a consumer for securing packages including goods delivered to the home from wrongful taking. The storage container may be secured to a door, window or the exterior of a building such as a residential home or office. It may be selectively removed from its place located on a building to a subsequent location without damage to the surface of the building.

In some embodiments, the storage container may be locked to prevent the package within the container from being removed before desired by the consumer.

In one aspect, the present disclosure is directed to a storage container including: a main compartment comprising a plurality of walls that define an enclosed space; an extension member comprising a first end portion, a second end portion opposite the first end portion, and an elongated body extending therebetween, the first end portion coupleable to at least one of the plurality of walls, the elongated body extendable through a gap defined by one of a lower surface and an upper surface of one or more of a door and a window; and a stopper extending from the second end portion of the extension member for use in securing the storage container to the one or more of a door and window.

BRIEF DESCRIPTION OF THE DRAWINGS

The disclosure will be better understood, and features, aspects and advantages other than those set forth above will become apparent when consideration is given to the following detailed description thereof. Such detailed description makes reference to the following drawings, wherein.

DETAILED DESCRIPTION

Unless defined otherwise, all technical and scientific terms used herein have the same meaning as commonly understood by one of ordinary skill in the art to which the disclosure belongs.

Generally, the present disclosure is directed to a storage container for use by a consumer for securing packages including goods delivered to a home, office, or other building from wrongful taking. The storage container may be secured to a door, window or other exterior surface of the home, office or other building. For example, the storage container of the present disclosure may be secured to an exterior door, such as a front door, side door, garage door, and the like. Alternatively, or additionally, the storage container may be secured to an exterior window.

It may be selectively removed from its position on a building to a subsequent position without damage to the surface of the building. More particularly, the present disclosure is directed to a storage container including: a main compartment comprising a plurality of walls that define an enclosed space; an extension member comprising a first end portion, a second end portion opposite the first end portion, and an elongated body extending therebetween, the first end portion coupleable to at least one of the plurality of walls, the elongated body extendable through a gap defined by one of a lower surface and an upper surface of one or more of a door and a window; and a stopper extending from the second end portion of the extension member for use in securing the storage container to the one or more of a door and window.

Figure 1A:
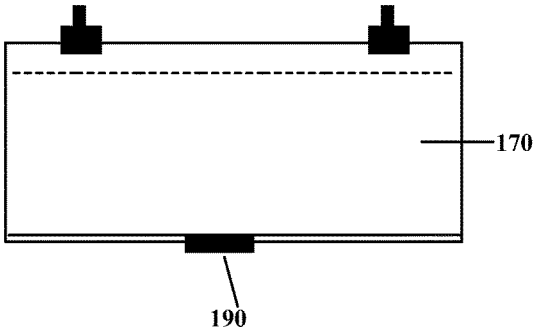
FIG. 1A depicts a top view of a storage container of a first embodiment of the present disclosure.
Figure 1B:
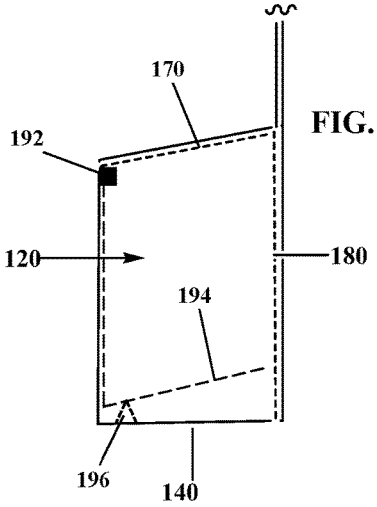
FIG. 1B depicts a side view of the storage container of the first embodiment of the present disclosure.
Figure 1C:
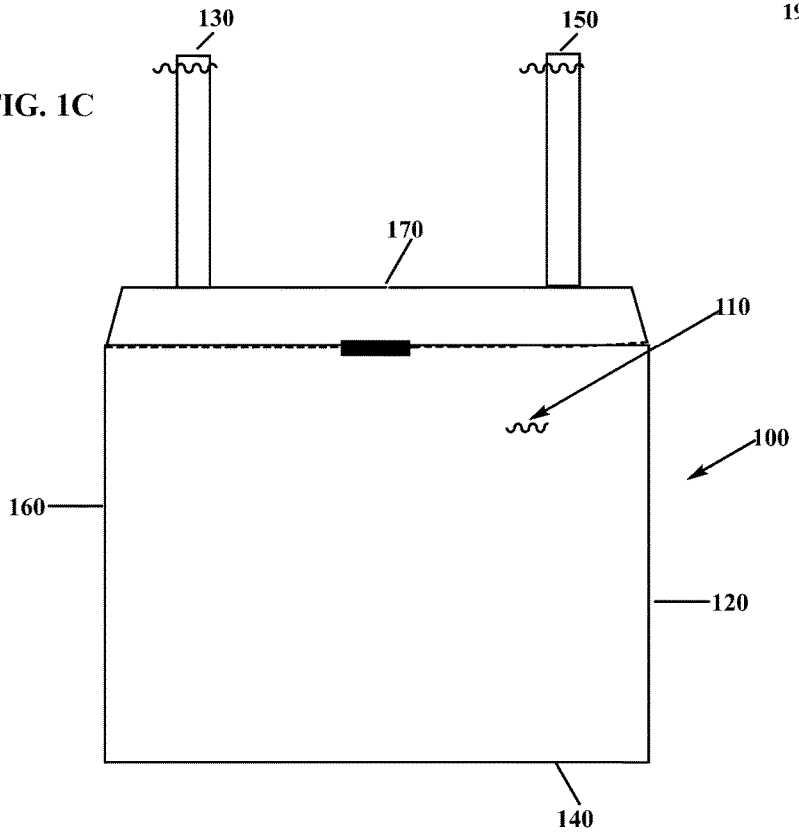
FIG. 1C depicts a front view of the storage container of the first embodiment of the present disclosure.

The main compartment may be any container and/or device capable of holding a package or product. The compartment includes a plurality of walls that define an enclosed space for holding a package. As shown in FIGS. 1A-1C, the main compartment is a box-type compartment including four side walls 110, 120, 160, 180, a bottom 140 and a top 170, defining a cubical-shaped enclosed space (not shown). While shown as a cubical-shaped box, it should be understood that the compartment may include walls such to include an enclosed space in the shape of a cube, rectangle, cone, or any other shape known in container arts for holding packages without departing from the present disclosure.

The main compartment may be sized to fit any sized package or good within the enclosed space to be delivered to a consumer. Accordingly, the present disclosure is directed to any of a variety of sizes. By way of example only, however, in some embodiments, the main compartment has a depth ranging from about 6 inches to about 48 inches, including about 8 inches to about 36 inches, and including from about 12 inches to about 24 inches.

The main compartment may include, for example, a height ranging from about 4 inches to about 36 inches, including about 5 inches to about 24 inches, and including about 6 inches to about 12 inches.

The main compartment further may include, in some embodiments, a width ranging from about 6 inches to about 48 inches, including about 7 inches to about 36 inches, and including from about 8 inches to about 24 inches.

Further, the walls of the main compartment may be made from any material known in the container arts. For example, the walls may be made of wood, plastic, plexiglass, carbon fiber, metal, and the like, and combinations thereof.

Figure 2A:
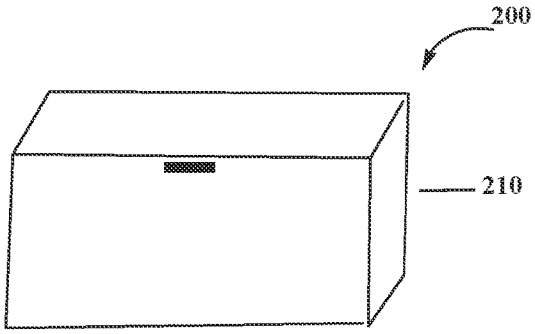
FIG. 2A depicts a front view of a storage container of a second embodiment of the present disclosure.
Figure 2B:
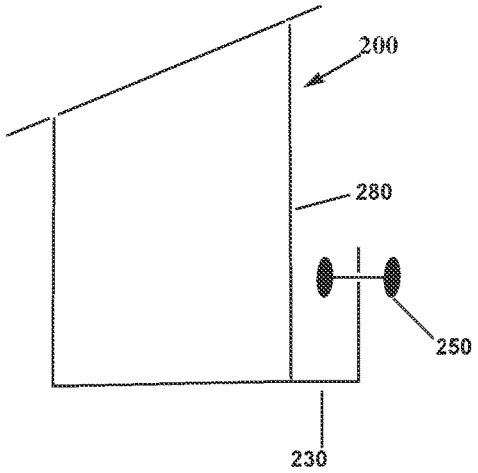
FIG. 2B depicts a side view of the storage container of the second embodiment of the present disclosure.
Figure 2C:
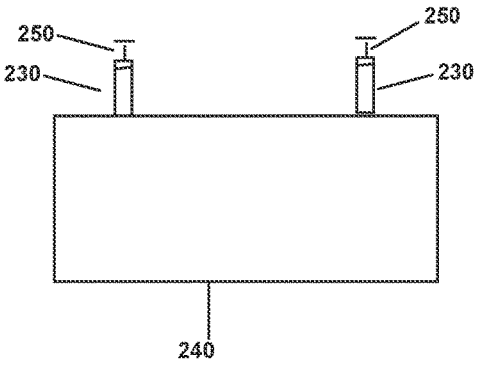
FIG. 2C depicts a top view of the storage container of the second embodiment of the present disclosure.

As shown in FIGS. 2A-2C, the main compartment 200 may be securely coupled to the surface of the building using an extension member 230 and a stopper 250. The extension member 230 is coupled to at least one of the plurality of walls (by way of example, wall 280 in FIG. 2B) using any coupling means known in the art. By way of example, the extension member 230 may be coupled to the main compartment using a fastening means such as screws, nails, staples, adhesive, welding, magnets, and combinations thereof, and any other means known in the art for coupling the compartment to the building.

The extension member is any component for use with the storage container that serves as a connection from the main compartment located on the exterior of the door, window, or other exterior surface of the building and the interior surface of the building. Typically, the extension member includes an elongated body that extends through a gap defined by one of a lower surface or an upper surface of a door, window, or other opening on the exterior of a building. The extension member may include a solid or hollow tubular structure, solid or hollow rod, one or a plurality of straps, or any other elongated body component capable of extending through a gap to connect the main compartment located on the exterior surface of a building to an interior surface of the building.

Figure 4A:
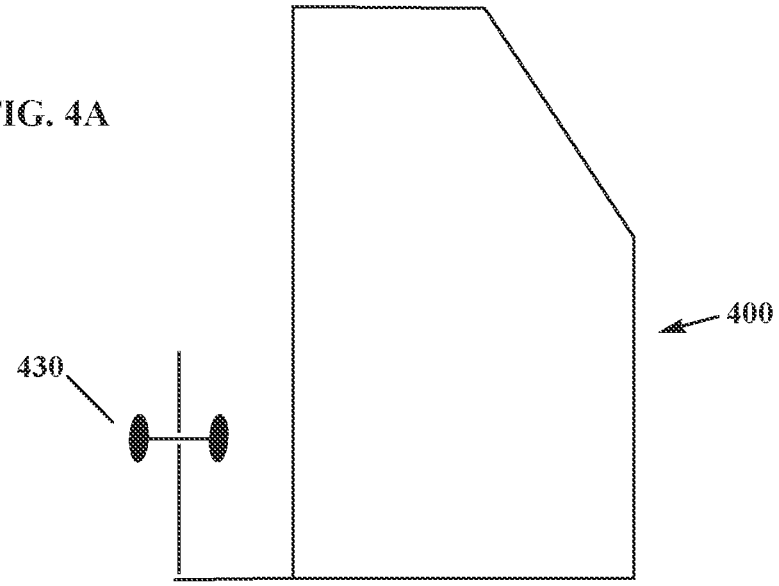
FIG. 4A depicts a side view of a storage container of a fourth embodiment of the present disclosure.
Figure 4B:
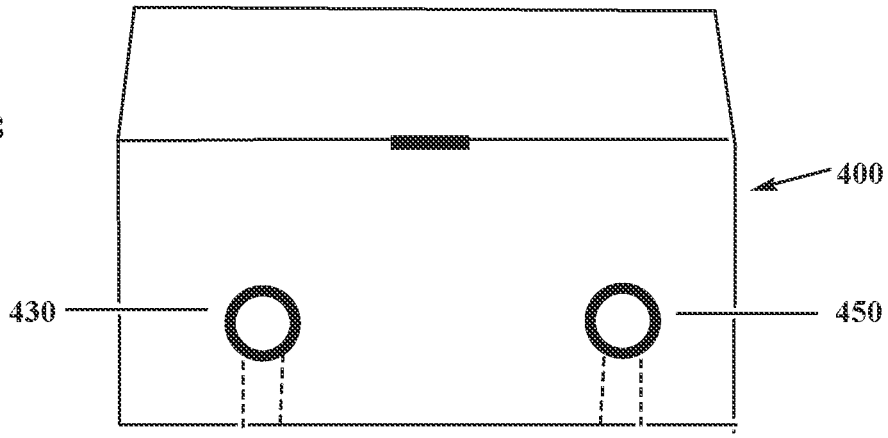
FIG. 4B depicts a rear view of the storage container of the fourth embodiment of the present disclosure.

At an end of the extension member opposite the end coupled to the wall(s) of the main compartment is typically a stopper. The stopper functions to secure the storage container to the surface of the building without damaging the surface. The stopper may be part of the extension member or a separate component that extends from the extension member at the end opposite the end coupled to the wall(s) of the main compartment. For example, in one embodiment, the stopper is formed at the end of the extension member opposite the end coupled to the wall(s) of the main compartment and is in the form of a hook, thereby securing the storage container to the surface of a building. In another embodiment, the stopper is a separate component from the extension member. By way of example, as shown in FIG. 2B, the stopper includes a clamp 250 that attaches to the extension member opposite the end coupled to the wall(s) of the main compartment. Other means of attaching the storage container to the surface of the building can be used without departing from the scope of the present disclosure (see FIGS. 4A & 4B, storage container 400 is fastened to the surface of a building (not shown) using a knob fastener 430 and 450). In yet other embodiments, the stopper may include straps that run the entire length of the extension member and extend out from the extension member. The straps may be cinched (e.g., tied/knotted clamped) such to secure the storage container to the surface of a building.

By way of specific example, and not to be limiting, FIGS. 1A-1C show one embodiment of a storage container of the present disclosure. The storage container 100 includes a main compartment 110 having 4 side walls 110, 120, 160, 180, a bottom 140, and a top 170, forming a cubical enclosed space. The main compartment 110 is coupled to two extension members 130, 150 at the top of side wall 180. The extension members 130, 150 extend in an upward direction and may be used with a stopper (not shown) to secure the main compartment 110 to the top of a door or window, for example, used with a clamp to secure the main compartment to the surface of a building.

As shown in FIG. 1A, the main compartment 110 may further be secured such that the enclosed space is protected from unwanted entry. The main compartment 110 may be secured with a latch 190. In some embodiments, the latch is replaced with a lock 192, such as a code lock or digital lock. In yet further embodiments, within the enclosed space of the main compartment, there is a beveled plane 194 on top of a fulcrum 196. Upon placing a package into the enclosed space, a lock 192 is engaged with the main compartment, thereby securing the package within the main compartment of the storage container.

In FIGS. 2A-2C, the storage container includes a main compartment 210 with a cubical enclosed space. The extension members 230 extend from the bottom 240 of the main compartment 210 to couple with a clamp stopper 250. The clamp stopper 250 may be secured onto a door or window of a building.

Figure 3:
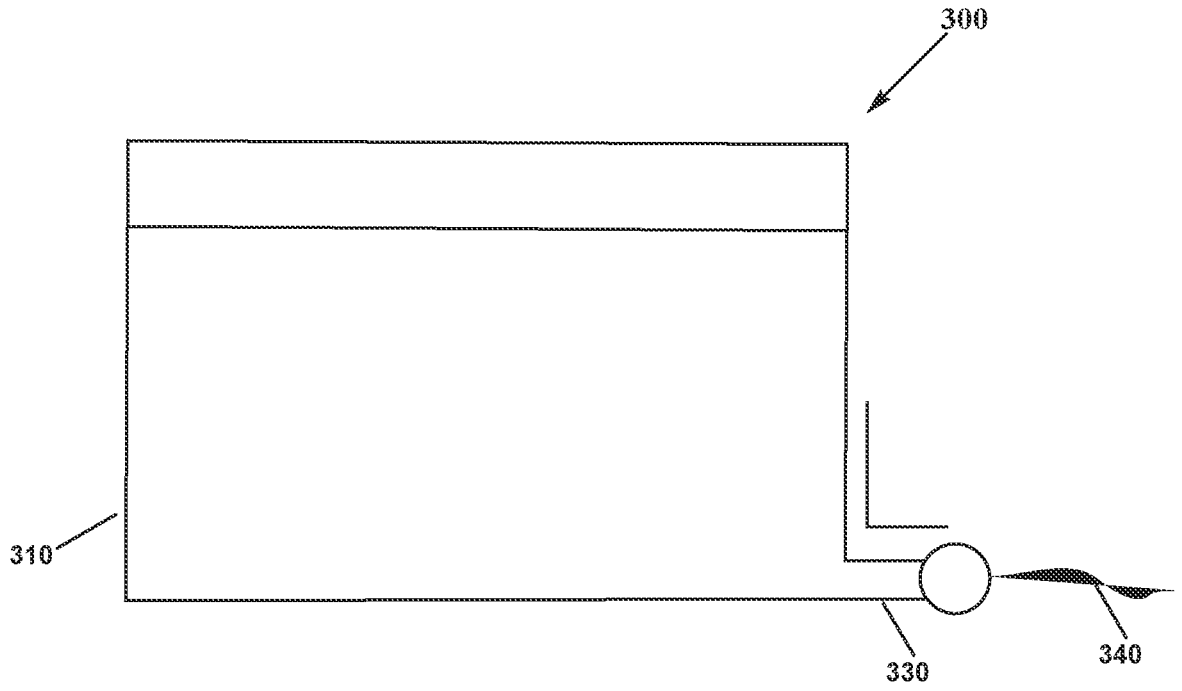
FIG. 3 depicts a side view of a storage container of a third embodiment of the present disclosure.

In FIG. 3, the main compartment 310 is coupled to a tubular extension member 330. Within the tubular extension member 330, strap 340 runs and exits the extension member 330 opposite the main compartment 310. The strap 340 may be cinched such to secure the storage container to a home, office or other building.

Whereas particular embodiments have been described above for purposes of illustration, it will be appreciated by those skilled in the art that numerous variations of the details may be made without departing from the disclosure as described in the appended claims.

What is claimed is:

1. A storage container comprising:

a main compartment comprising a plurality of walls that define an enclosed space;

an extension member comprising a first end portion, a second end portion opposite the first end portion, and an elongated body extending therebetween, the first end portion coupleable to at least one of the plurality of walls, the elongated body extendable through a gap defined by one of a lower surface and an upper surface of one or more of a door and a window of a building; and a stopper attached to the second end portion of the extension member and configured to secure the storage container to the one or more of the door and the window of the building;

wherein the stopper comprises a tube having a length, and a strap extending along the length within the tube, the strap coupled to the second end portion of the extension member.

2. The storage container as set forth in claim 1, wherein the main compartment comprises a depth ranging from 6 inches to about 48 inches.

3. The storage container as set forth in claim 1, wherein the main compartment comprises a height ranging from 4 inches to about 36 inches.

4. The storage container as set forth in claim 1, wherein the main compartment comprises a width ranging from 6 inches to about 48 inches.

5. The storage container as set forth in claim 1, wherein the main compartment is in a shape selected from the group consisting of cubical, rectangular, and conical.

6. The storage container as set forth in claim 1, wherein the main compartment is made of a material selected from the group consisting of wood, plastic, plexiglass, carbon fiber, metal, and combinations thereof.

7. The storage container as set forth in claim 1, wherein the strap is cinchable.

8. The storage container as set forth in claim 1, further comprising a fulcrum in the enclosed space, a beveled plane on the fulcrum, and a lock configured to secure an orientation of the beveled plane.

9. The storage container as set forth in claim 1, further comprising a latch configured to secure the main compartment.

10. The storage container as set forth in claim 1, in combination with the window of the building, the storage container secured to the window.

11. The storage container as set forth in claim 10, wherein the strap is cinched to the window.

12. The storage container as set forth in claim 1, in combination with the door of the building, the storage container secured to the door.

13. The storage container as set forth in claim 12, wherein the strap is cinched to the door.

14. The storage container as set forth in claim 1, wherein the plurality of walls includes a bottom wall, opposite left and right side walls extending upward from the bottom wall, opposite front and rear side walls extending upward from the bottom wall and extending between the left and right side walls, and a top wall.

15. The storage container as set forth in claim 14, wherein the top wall slants downward as the top wall extends from a rear edge to a front edge.

16. The storage container as set forth in claim 1, further comprising a lock configured to secure the main compartment.

* * * * *